US005795202A

United States Patent [19]

Williams

[11] Patent Number: 5,795,202

[45] Date of Patent: Aug. 18, 1998

[54] OUTBOARD MOTOR SUPPORT DEVICE

[76] Inventor: Carl F. Williams, 3815 64th Street NE., Tuscaloosa, Ala. 35406

[21] Appl. No.: 707,741

[22] Filed: Sep. 4, 1996

[51] Int. Cl.[6] ..... B63H 20/00

[52] U.S. Cl. ..... 440/113; 248/640; 440/55

[58] Field of Search ..... 440/900, 113, 440/53, 63, 55; 248/640, 642

[56] References Cited

U.S. PATENT DOCUMENTS

| | | | |
|---|---|---|---|
| 3,693,576 | 9/1972 | Driscoll | 280/414 R |
| 3,941,344 | 3/1976 | Paterson | 248/351 |
| 4,125,236 | 11/1978 | Landwerlen | 248/4 |
| 4,331,431 | 5/1982 | Estes | 440/53 |
| 4,501,561 | 2/1985 | Speelman | 440/61 |
| 4,650,427 | 3/1987 | Huchinson | 440/55 |
| 4,651,964 | 3/1987 | Kendrick | 248/351 |
| 4,685,888 | 8/1987 | Brewer | 440/53 |
| 4,828,186 | 5/1989 | Weiss | 248/640 |
| 4,842,239 | 6/1989 | Kinsey et al. | 248/640 |
| 5,021,016 | 6/1991 | Currey | 440/113 |
| 5,031,842 | 7/1991 | Mohr | 248/640 |
| 5,393,251 | 2/1995 | Gilbert | 440/59 |

*Primary Examiner*—Sherman Basinger
*Attorney, Agent, or Firm*—Lanier Ford Shaver & Payne P.C.; Frank M. Caprio

[57] ABSTRACT

An outboard boat motor support device attachable between the boat transom and outboard motor to help prevent the outboard motor from inflicting damaging torque to the transom mounting point during trailering or water operation is provided comprising a rigid plate fixedly attached to the transom of the boat and a support member capable of being retracted within the plate or extended from the boat to engage the lower casing of the outboard motor in a tilted position, thereby maintaining the outboard motor in the tilted position during trailering.

4 Claims, 3 Drawing Sheets

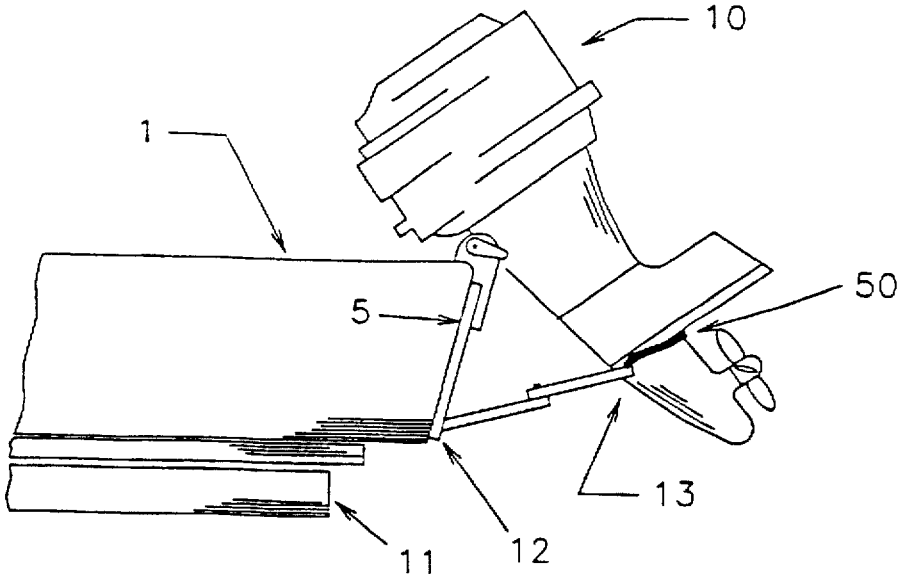
FIGURE 1
FIGURE 2
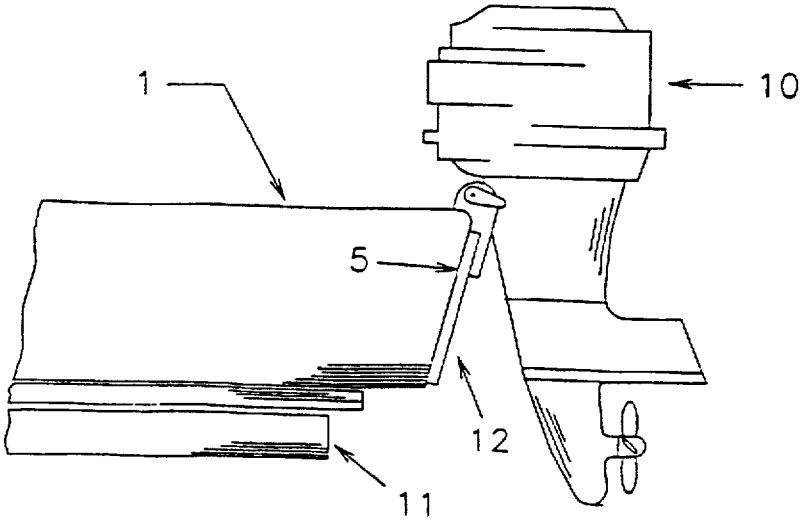

OUTBOARD MOTOR SUPPORT DEVICE

BACKGROUND OF THE INVENTION

1. Field of the Invention

This invention relates to an apparatus for maintaining an outboard boat motor in a tilted position. The apparatus is fixedly mounted to the transom of a boat and is capable of maintaining the outboard boat motor in a tilted position during trailering, and provides for more even distribution of the torque created at the boat transom by the outboard motor during water operation.

2. Prior Art

For many years boats have been fabricated with the idea that an outboard motor would be attached to the boat's transom to power the boat. During water operation, the force of the outboard motor propelling the boat creates a torque at the mounting point of the outboard motor to the transom of the boat. Also, most outboard motors are very heavy and cannot readily be removed from the transom of the boat once they are attached. For these reasons, transoms of boats are built of increased strength in an attempt to withstand water operation and accommodate transporting the boat with the motor attached while carried on a conventional boat-trailer.

While being transported, it is a general practice to raise the motor to a tilted position to prevent the bottom of the motor from striking the ground when the trailer hits a bump in the road. This configuration creates added torque at the mounting point of the outboard motor to the transom whenever the trailer hits a bump in the road. In the past, there have been many attempts to alleviate the torque created at the transom mounting point during trailering by installing some sort of support extending from the boat trailer to the lower casing of the outboard motor itself. Several examples of U.S. patents disclosing attempts at this solution are disclosed in the following table.

| U.S. PAT. NO. | INVENTOR | ISSUED | TITLE |
|---|---|---|---|
| 3,693,576 | Driscoll | 9/26/72 | Outboard Motor Stabilizer |
| 3,941,344 | Paterson | 3/2/76 | Motor Support |
| 4,125,236 | Landwerlen | 11/14/78 | Transom Saver |
| 4,331,431 | Estes | 5/25/82 | Transom Saver |
| 4,501,561 | Speelman | 2/26/85 | Brace Device for Motorboat Drive Unit |
| 4,650,427 | Huchinson | 3/17/87 | Spring Action Boat Motor Support |
| 4,651,964 | Kendrick | 3/24/87 | Traveling Support Rod for Outboard Engine |
| 4,685,888 | Brewer | 8/11/87 | Outboard Motor Support |
| 4,828,186 | Weiss | 5/9/89 | Boat Motor Support |
| 4,842,239 | Kinsey, et al. | 6/27/89 | Outboard Boat Motor Support Device |
| 5,021,016 | Currey | 6/4/91 | Outboard Motor Support |
| 5,031,842 | Mohr | 7/16/91 | Outboard Motor Support Strut |
| 5,393,251 | Gilbert | 2/28/95 | Outboard Motor Support |

One problem with these devices is the time and burden of installing these support devices between the trailer and the outboard motor. Also, separate devices for supporting the outboard motor can be misplaced or lost. Moreover, none of the existing devices have any functionality while the boat is in water operation.

SUMMARY OF THE INVENTION

It would be preferable to have a device which can support the weight of the outboard motor in a tilted position when trailering which is fixedly attached to the boat itself, eliminating the problem of having to install a separate support device. Moreover, a device that is fixedly attached to the boat would alleviate problems of inter-operability between the boat trailer and the support device itself.

Therefore, it is an object of the present invention to provide a device having a rigid plate fixedly attached to the boat and a support member capable of being extended to maintain the boat motor in a tilted position thereby diminishing the torque created at the transom mounting point during trailering. Also, the support member should be capable of being retracted into the fixedly mounted rigid plate.

The support member should be telescopic or otherwise extendable to accommodate the spacial limitations associated with being fixedly attached to the boat. In one embodiment, the support member should be a two-piece unit comprising a first support member and a second support member rotatably or hingedly attached together such that the second support member rotates from a retracted position collinear and coextensive with the first support member to a second position extended out and away from the first support member.

It is another object of the invention to be fixedly mounted to the transom of the boat between the boat motor and the transom such that any torque created at the transom mounting point by the outboard motor during water operation would be more evenly distributed over the transom of the boat rather than concentrated at the transom mounting point.

These and other objects and advantages of this invention shall become apparent from the ensuing description of the invention.

Accordingly, an outboard boat motor support device attachable between the boat transom and outboard motor to help prevent the outboard motor from inflicting damaging torque to the transom mounting point during trailering or water operation is provided comprising a rigid plate fixedly attached to the transom of the boat and a support member capable of being retracted within the plate or extended from the boat to engage the lower casing of the outboard motor in a tilted position, thereby maintaining the outboard motor in the tilted position during trailering.

BRIEF DESCRIPTION OF THE DRAWINGS

FIG. 1 is a side view of the support device attached to the boat transom and extended to engage the motor.

FIG. 2 is a side view of the support device attached to the boat transom and retracted into is water operable position.

PREFERRED EMBODIMENTS OF THE INVENTION

Figure 3:
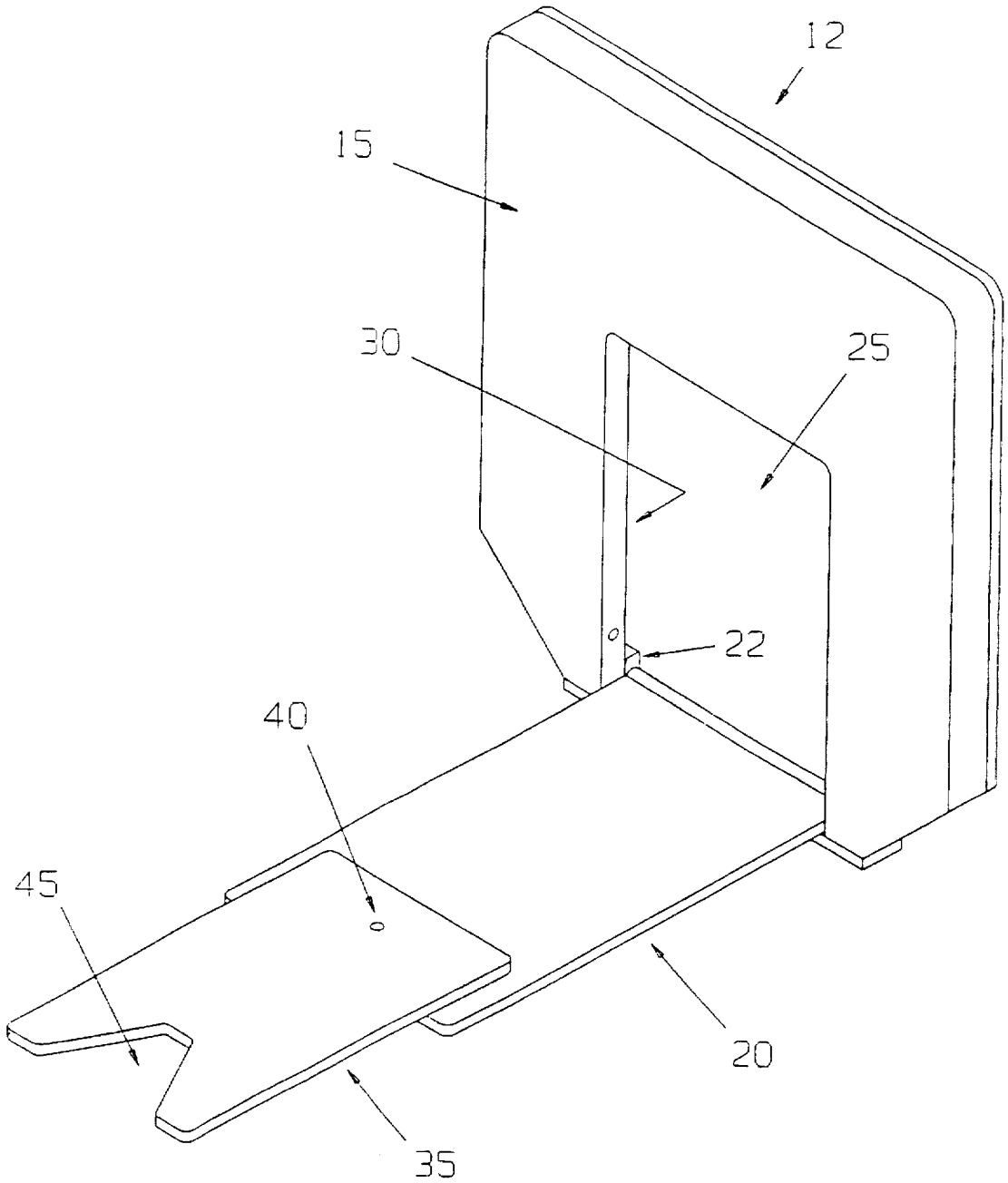
FIG. 3 is a perspective view of the support device with the support members extended.
Figure 4:
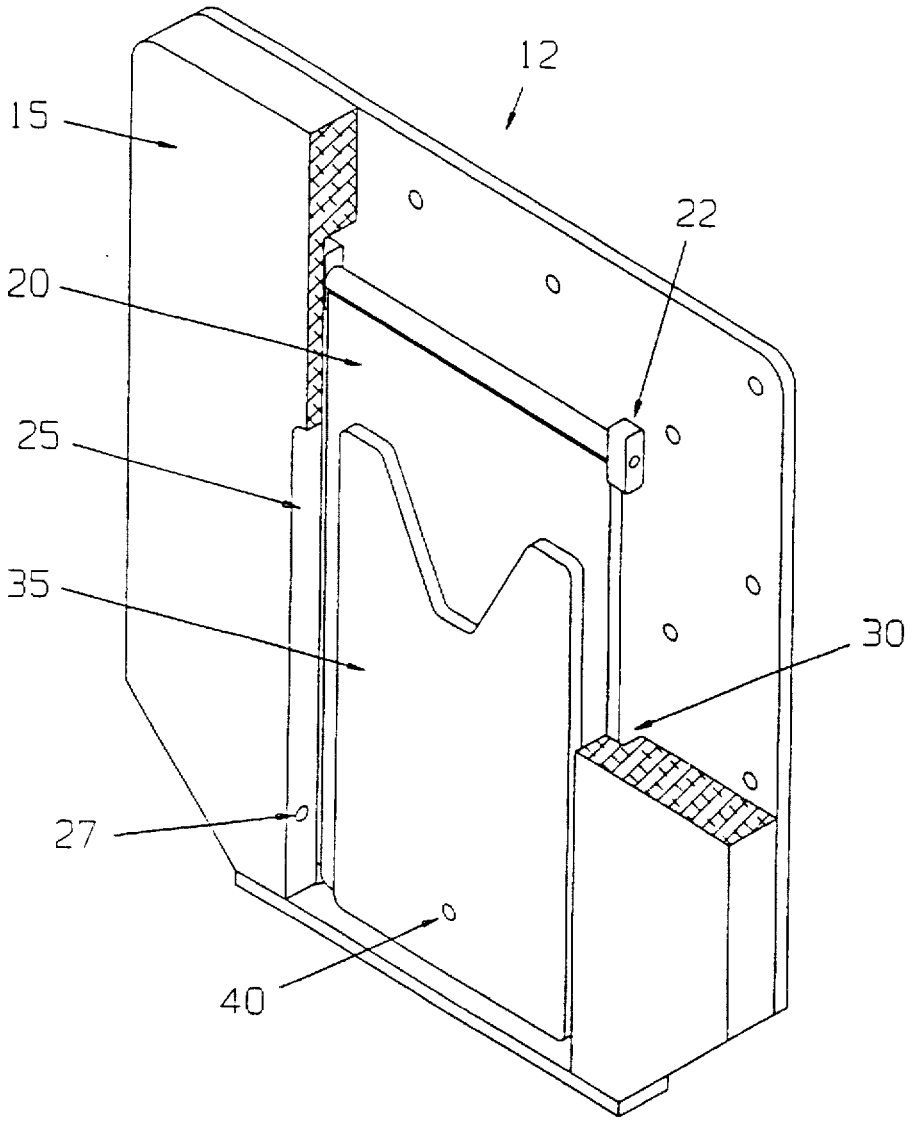
FIG. 4 is a perspective view of the support device with the support members retracted.

The support device 12 is best shown through the perspective views in FIGS. 3 and 4. The preferred embodiment of the support device 12 consists of three (3) elements: a rigid plate 15, a substantially rectangular first support member 20, and a second support member 35. In a preferred embodiment, all elements of support device 12 are made of a material that will resist corrosion. The rigid plate 15 contains a rectangular cavity 25 longitudinally disposed through the length of rigid plate 15. In a preferred embodiment, the rigid plate 15 is made of a material of sufficient hardness, such as aluminum, to disperse the torque created at the transom mounting point by the boat motor over a larger area. On either side of the cavity 25 are grooves 30 which facilitate the slidable movement of the first support member 20. In the preferred embodiment, at both sides of one end of the first support member 20 are two groove riders 22 which engage within the grooves 30 to facilitate the slidable and hinged movement. At the distal end of the first support member 20 is a hinge 40 which is coupled to one end of the second support member 35 enabling the second support member 35 to rotate about a fixed point at the hinge 40. The distal end of second support member 35 contains a V-shaped notch 45 for engaging the lower casing of the outboard motor 13. It will be obvious to those skilled in the art that V-shaped notch 45 can be fitted with a nonabrasive material, such as nylon, to prevent scarring of lower casing 13.

In an alternate embodiment, support member 20 has a first end and a distal end, with the first end being hingedly attached to rigid plate 15, and the distal end having a V-shaped notch for engaging the boat motor and for maintaining the boat motor in the tilted position.

FIG. 3 illustrates the support device 12 in its extended position with the first support member 20 and second support member 35 in position to engage the lower casing of the outboard motor 13. FIG. 4 illustrates the support device 12 in its retracted position capable of water operation. Referring to FIGS. 3 and 4, retraction of the support members 20 and 35 is effected by first rotating the second support member 35 about hinge 40 such that the V-shaped notch 45 is at a point closest to the groove riders 22 and second support member 35 lays atop first support member 20. Then, first support member 20 is slid to its retracted position within the cavity 25 of the plate 15 by slideably translating the first support member 20 along grooves 30 to the retracted position within plate 15.

Turning now to FIG. 1, the support device 12 is shown flushly attached to the transom of boat 1 and securely mounted between outboard boat motor 10 and transom 5. In its extended position, V-shaped notch 45 of second support member 35 engages the lower casing of the outboard motor 13 and maintains outboard motor 10 in its tilted position. It will be obvious to those skilled in the art that a tie strap 50 may be connected at both sides of second support member 35 to prevent the motor 10 from bouncing out of the V-shaped notch 45 during trailering.

Turning to FIG. 2, in its retracted position support device 12 is completely disengaged from the lower portion of the outboard motor 13. A restraint mechanism should be employed to prevent the first support member 20 from sliding out of the cavity 25 during water operation. In the preferred embodiment, a spring loaded restraint pin 27 is used on either side of the lower portion of the cavity 25. This is illustrated in FIG. 4. In this configuration, the support device 12 functions to more evenly transfer the torque created by outboard motor 10 at the transom 5 while propelling the boat 1 through the water during water operation.

It will of course be understood that changes may be made in the form, details, arrangements and proportions of the elements of the support device herein described without departing from the scope of the invention which is set forth generally in the following claims.

The invention claimed is:

1. An apparatus for maintaining an outboard boat motor in a tilted position, comprising:

(a) a rigid plate being for fixed attachment to the transom of a boat and defining a cavity longitudinally disposed through the length of the rigid plate; and (b) a first support member having an extended end and an attached end, the attached end slideably and hingedly attached within the cavity of the rigid plate in such a manner that the first support member slides from a first position fully extended without the cavity to a second position fully contained within the cavity; and (c) a second support member having a first end rotatably attached to the extended end of the first support member, and an engaging end operative for engaging the boat motor; and (d) means for restraining the first support member in its second position within the cavity of the rigid plate.

2. The apparatus of claim 1 wherein the rigid plate is fixedly attached to the boat transom between the transom and the outboard boat motor.

3. The apparatus of claim 2 wherein:

(a) the cavity of the rigid plate is substantially rectangular; and (b) the first support member is substantially rectangular.

4. An apparatus for maintaining an outboard boat motor in a tilted position, comprising:

(a) a rigid plate King fixedly attached between the transom of a boat and the outboard motor, the rigid plate having a substantially rectangular cavity longitudinally disposed through the length of the rigid plate and partially contained within the rigid plate; and (b) a substantially rectangular first support member having an extended end and an attached end, the attached end slideably and hingedly attached within the cavity of the rigid plate in such a manner that the first support member slides from a first position fully extended without the cavity to a second position fully contained within the cavity; and (c) a second support member having a first end rotatably attached to the extended end of the first support member and an engaging end with a V-shaped groove operative for engaging the boat motor; and (d) means for restraining the first support member in its retracted position within the rectangular cavity of the rigid plate.

* * * * *

UNITED STATES PATENT AND TRADEMARK OFFICE

CERTIFICATE OF CORRECTION

PATENT NO. : 5,795,202

DATED : August 18, 1998

INVENTOR(S) : Carl F. Williams

It is certified that error appears in the above-identified patent and that said Letters Patent is hereby corrected as shown below:

Col. 4, line 36
replace "King"
with --being--.

Signed and Sealed this

Twenty-fourth Day of November, 1998

*Attest:*

Bruce Lehman

BRUCE LEHMAN

*Attesting Officer*

*Commissioner of Patents and Trademarks*